US006132534A

United States Patent [19]

Roberts et al.

[11] Patent Number: 6,132,534

[45] Date of Patent: Oct. 17, 2000

[54] LIQUID QUENCHING APPARATUS AND METHOD

[75] Inventors: Richard P. Roberts; Michael A. Schmidt, both of Meadville, Pa.

[73] Assignee: Seco/Warwick Corp., Meadville, Pa.

[21] Appl. No.: 09/044,078

[22] Filed: Mar. 19, 1998

[51] Int. Cl.[7] ..... C21D 6/00

[52] U.S. Cl. ..... 148/660; 266/131; 266/133

[58] Field of Search ..... 266/114, 130, 266/131, 132, 133; 148/157, 644, 660

[56] References Cited

U.S. PATENT DOCUMENTS

| | | | |
|---|---|---|---|
| 1,601,497 | 9/1926 | Greene . | |
| 2,273,528 | 2/1942 | Karp . | |
| 3,531,096 | 9/1970 | Krach et al. . | |
| 3,532,330 | 10/1970 | Swanson . | |
| 3,650,853 | 3/1972 | Keough . | |
| 3,944,053 | 3/1976 | Hayes . | |
| 3,964,734 | 6/1976 | Kreidler et al. . | |
| 4,025,297 | 5/1977 | Smith et al. | 266/133 |
| 4,036,478 | 7/1977 | Smith et al. . | |
| 4,353,531 | 10/1982 | Pierrel et al. . | |

FOREIGN PATENT DOCUMENTS

| | | |
|---|---|---|
| 1 583 415 | 8/1970 | Germany . |
| 1 541 286 | 2/1990 | U.S.S.R. . |

*Primary Examiner*—Scott Kastler
*Attorney, Agent, or Firm*—Oliff & Berridge, PLC

[57] ABSTRACT

The liquid quenching system includes a method and apparatus for heat treating small parts discharged from a furnace. The apparatus includes a bearing and bearing support that provide cantilevered support to a rotary quenching drum. A rotatable joint that rotatably connects the rotary quenching drum to a transfer chute does not provide the majority of support for the rotary quenching drum. Accordingly, the rotatable joint can comprise no bearing at all or can be an inexpensive, easy to manufacture bearing or other juncture device. A protection member is connected to the output end of the transfer chute and protects the rotatable joint from damage from contact with metal parts that are being quenched.

23 Claims, 8 Drawing Sheets

LIQUID QUENCHING APPARATUS AND METHOD

BACKGROUND OF THE INVENTION

1. Field of Invention

The invention relates to a liquid quenching system for use with continuous furnaces for heat treating small parts. In particular, the invention relates to a bearing, rotatable joint and protection member and the method of their use in conjunction with a rotary quenching drum of the liquid quenching system.

2. Description of Related Art

Continuous heat treating furnaces such as conveyor belt, shaker hearth, shuffle hearth or rotary retort furnaces are often used to heat treat large quantities of relatively small parts, such as screws, nuts, washers, bolts and pins. The handling of such small parts, particularly during the quenching process, has long presented many different problems.

A first problem involves the metallurgical requirements for a thorough quench of each small part. Another problem includes the practical economic requirements for recovery of the quenched pieces. Installation and maintenance of the quenching apparatus is itself problematic, and the need to minimize both the initial quantity of quenchant required and the loss of quenchant during use also present serious problems. Finally, in rotary quenching drum type liquid quenching systems, a problem exists wherein the small parts become lodged in the bearing and seals that seal the rotary quenching drum in rotational relationship with respect to the quench chute that discharges the small parts into the rotary quenching drum.

It has long been the practice in the conventional art to include pit type quench systems, such as those shown in U.S. Pat. No. 3,531,096 to Krach et al. and U.S. Pat. No. 3,650,853 to Keough for use in connection with furnaces of the conveyor belt, shaker hearth and shuffle hearth varieties. The disadvantages of such pit type quench systems have been appreciated. A system designed to overcome these disadvantages is disclosed in U.S. Pat. No. 4,036,478 to Smith et al., which is incorporated herein by reference. However, the liquid quenching system disclosed in the '478 patent suffers from many additional and different problems. In particular, parts being transferred from a transfer chute to the rotary quenching drum of the '478 patent sometimes become lodged in the seal between the transfer chute and the rotary quenching drum. As a result, the transfer chute and its seal can become damaged and scored, and sometimes the parts will make their way entirely through the seal and fall into the main quenching tank in which the rotary quenching drum is located. When a part falls into the quenching tank, the part will often be drawn into the recirculating system and will either clog the quenchant lines or jam the pump impeller or valving disposed inside of the quenchant lines.

Besides scoring the transfer chute, the parts that become lodged in the seal between the rotary quenching drum and transfer chute can potentially cause the rotary quenching drum to stop rotating and lock up.

The structure of the '478 patent does not facilitate quick and easy repair of the rotatable joint, which includes a bearing and seal between the rotary quenching drum and transfer chute, once the joint has become worn or damaged by stray parts. In addition, the location of the seal and bearing requires that they always be submerged in quenchant, which greatly accelerates their deterioration and ultimate need for repair. Accordingly, the seal between the drum and transfer chute must be replaced frequently because of damage caused by metal parts being caught between the seal and bearing, or through accelerated wear from being submerged in quenchant.

Thus, the industry lacks an apparatus and method for extending the operational life of the rotatable joint between the transfer drum and the transfer chute.

SUMMARY OF THE INVENTION

It is therefore an object of the invention to solve the above-mentioned problems, and provide an apparatus and method for eliminating the need for a bearing at the rotatable joint between the transfer chute and the rotary quenching drum while extending the operational life of the rotatable joint between the rotary quenching drum and the transfer chute. It is also an object of the invention to provide an improved liquid quenching system that prevents metal parts from getting lodged between the rotary quenching drum and the transfer chute. It is a further object of the invention to provide an improved liquid quenching system having a longer lasting structure that is better protected from general wear and tear and quick deterioration.

It is another object of the invention to provide a liquid quenching system for small parts wherein the quenchant serves to convey the parts as well as to quench them.

It is a further object of the invention to provide a liquid quench system which does not require a pit installed quench tank and attendant mechanical handling equipment submerged in the quench tank.

It is yet another object of the present invention to provide segregating means for segregating the combined quenchant and work parts. The segregating means permits the return of the quenchant to a reservoir and transfers substantially dry, heat treated and quenched parts to a suitable receptacle.

Another object of the invention is to prevent the need for replacement of the rotatable joint that connects the rotary quenching drum to the transfer chute due to deterioration of the joint caused by metal parts being caught in the rotatable joint or the constant submersion of the rotatable joint in quenchant.

Still another object of the invention is to provide a bearing means at the output end of the rotary quenching drum to relieve stress on the rotatable joint. The bearing means includes a bearing and bearing support which act as a cantilever to support the majority of weight of the rotary quenching drum. Accordingly, the rotatable joint at the input end of the rotary quenching drum need not be designed to support the weight of the rotary quenching drum.

It is another object of the invention to facilitate maintenance of the rotary quenching drum by providing the bearing on the outside of the rotary quenching drum. The bearing will act in conjunction with a bearing shaft to support the majority of weight of the rotary quenching drum.

Yet another object of the invention is to provide a reduction in cost for production of the rotary quenching drum by either eliminating the heavy duty bearings conventionally used at the joint between the transfer chute and rotary quenching drum or replacing the heavy duty bearings with a relatively cheap rotatable joint that is not required to support the weight of the rotary quenching drum. In the case that the rotatable joint does not comprise any bearing, the rotatable joint and could be a simple opening in the rotary quenching drum that allows the quench chute to pass therethrough. The rotatable joint is not required to support the weight of the rotary quenching drum because the bearing and bearing support are designed to provide cantilevered support to the rotary quenching drum at the output end of the rotary quenching drum.

A liquid quenching system for small parts in accordance with an embodiment of the invention conveys the parts by the quenchant from the discharge end of the furnace in which the parts are heat treated to a segregating device which separates the quenched parts from the quenchant and transfers the parts to a suitable receptacle or further conveying means. Heat treated parts discharged from a continuous furnace such as a conveyor belt, a shaker hearth, a shuffle hearth or a rotary retort type furnace drop into a funnel at an inlet end of a quench chute containing a quenchant. As the parts drop through the quench chute, they are simultaneously quenched and conveyed by the quenchant. Additional high-velocity quenchant may be pumped into the chute to convey the parts. The chute includes a portion that extends down, and a portion that is inclined upward. The portion that is inclined upward communicates with a reservoir of the quenchant. Both the parts and the conveying quenchant are discharged into segregating means which permit the quenchant to be returned, by the reservoir and a pump, to the quench chute. Less quenchant is required for this closed system than for the conventional pit type quench systems. The segregating means also transfers the parts that are completely heat treated and quenched directly into suitable receptacles.

In the preferred embodiment, the higher velocity quenchant is introduced into an annular space in the chute, immediately downstream from the inlet opening. The annular space is formed by the inner wall of the quench chute and the outer wall of the funnel which extends into the quench chute.

The segregating means is disposed partially within the quenchant reservoir and includes a rotatably mounted drum having an internal auger flight. The parts and quenchant are discharged below the liquid level in the reservoir to reduce noise, splashing and aeration of the quenchant. The rotation of the drum reduces the turbulence attendant to the discharge of the combined quenchant and parts. The rotation of the drum also moves the parts out of the reservoir and causes them to drain and "tumble dry" before they are discharged into suitable receptacles.

In an alternative embodiment, the additional quenchant is pumped into the quench chute at an end of the downward portion of the chute, adjacent the upwardly inclined portion.

In accordance with another embodiment of the invention, a quenching apparatus for quenching heated parts includes a rotary quenching drum having an input end and an output end. The input end includes a floor member. A quench chute transports heated parts to the rotary quenching drum. A rotatable joint connects the quench chute to the rotary quenching drum such that the rotary quenching drum is rotatable relative to the quench chute. A protection member positioned over the rotatable joint protects the rotatable joint from contact with the heated parts.

In accordance with another embodiment of the invention, a quenching apparatus for quenching heated parts includes a rotary quenching drum having an input end and an output end. A quench chute is rotatably connected by a rotatable joint to the rotary quenching drum and delivers heated parts to the rotary quenching drum. A protection apparatus is positioned over the rotatable joint for protecting the rotatable joint from contact with the heated parts.

In accordance with another embodiment of the invention, a quenching apparatus for quenching heated parts includes a rotary quenching drum having an input end and an output end, a quench chute for transporting heated parts to the rotary quenching drum, and a rotatable joint connecting the quench chute to the rotary quenching drum such that the rotary quenching drum is rotatable relative to the quench chute. A bearing mechanism is located at the output end of the rotary quenching drum for supporting a majority of the weight of the rotary quenching drum.

In accordance with another embodiment of the invention, a method for quenching heated parts using a quenching apparatus that includes a rotary quenching drum having a rotatable joint connected to a quench chute includes drawing heated parts from a furnace to the rotary quenching drum using a quenchant fluid to provide the motive force. The method further includes providing the rotary quenching drum with a protection member at the rotatable joint to protect the rotatable joint from contact with the heated parts, and removing the heated parts from the quenchant fluid and from an outlet end of the rotary quenching drum.

Further objects and advantages of the present invention will become apparent as the following description proceeds, and the features of novelty which characterize the invention will be particularly pointed out in the claims annexed to and forming a part of the specification.

BRIEF DESCRIPTION OF THE DRAWINGS

These and other aspects and advantages of the invention will become apparent from the following detailed description of preferred embodiments when taken in conjunction with the accompanying drawings, in which.

DETAILED DESCRIPTION OF PREFERRED EMBODIMENTS

Figure 1:
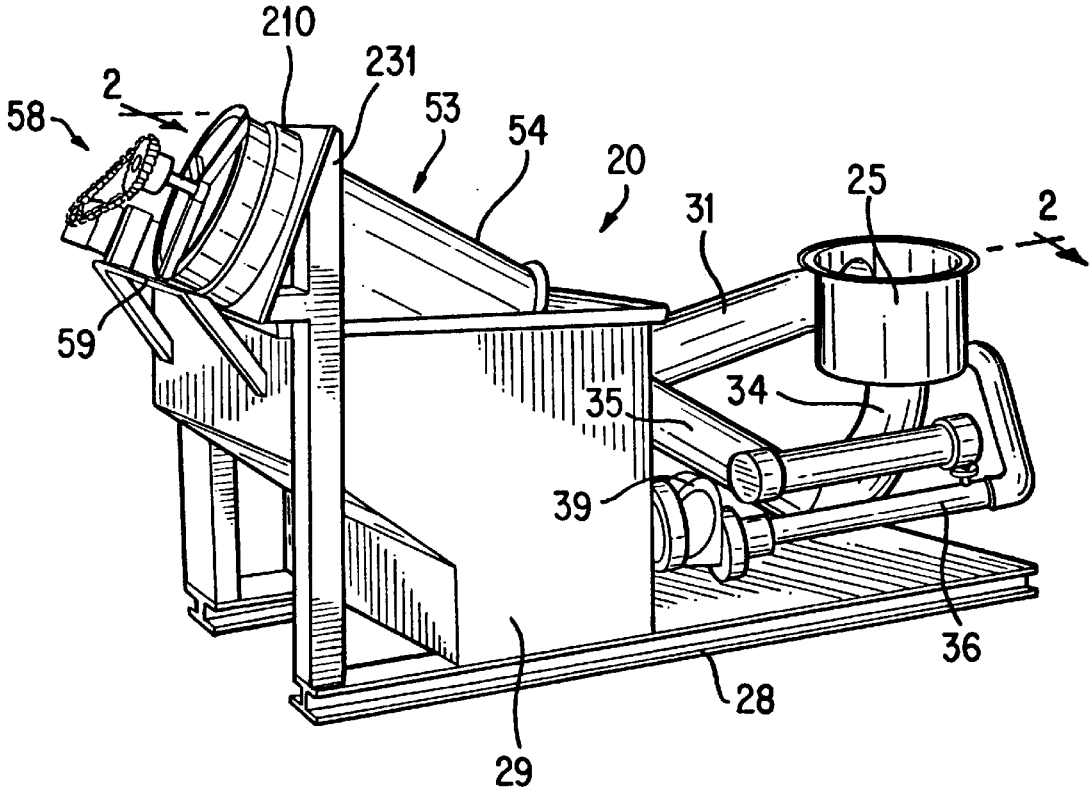
FIG. 1 is a perspective view in accordance with an embodiment of the invention.

While the invention will hereinafter be described in connection with preferred embodiments thereof, it will be understood that it is not intended to limit the invention to those embodiments. On the contrary, it is intended to cover all alternatives, modifications and equivalents that may be included within the spirit and scope of the invention as defined by the appended claims.

For a general understanding of the features of the invention, reference is made to the drawings. In the drawings, like reference numerals have been used throughout to designate identical elements.

Figure 2:
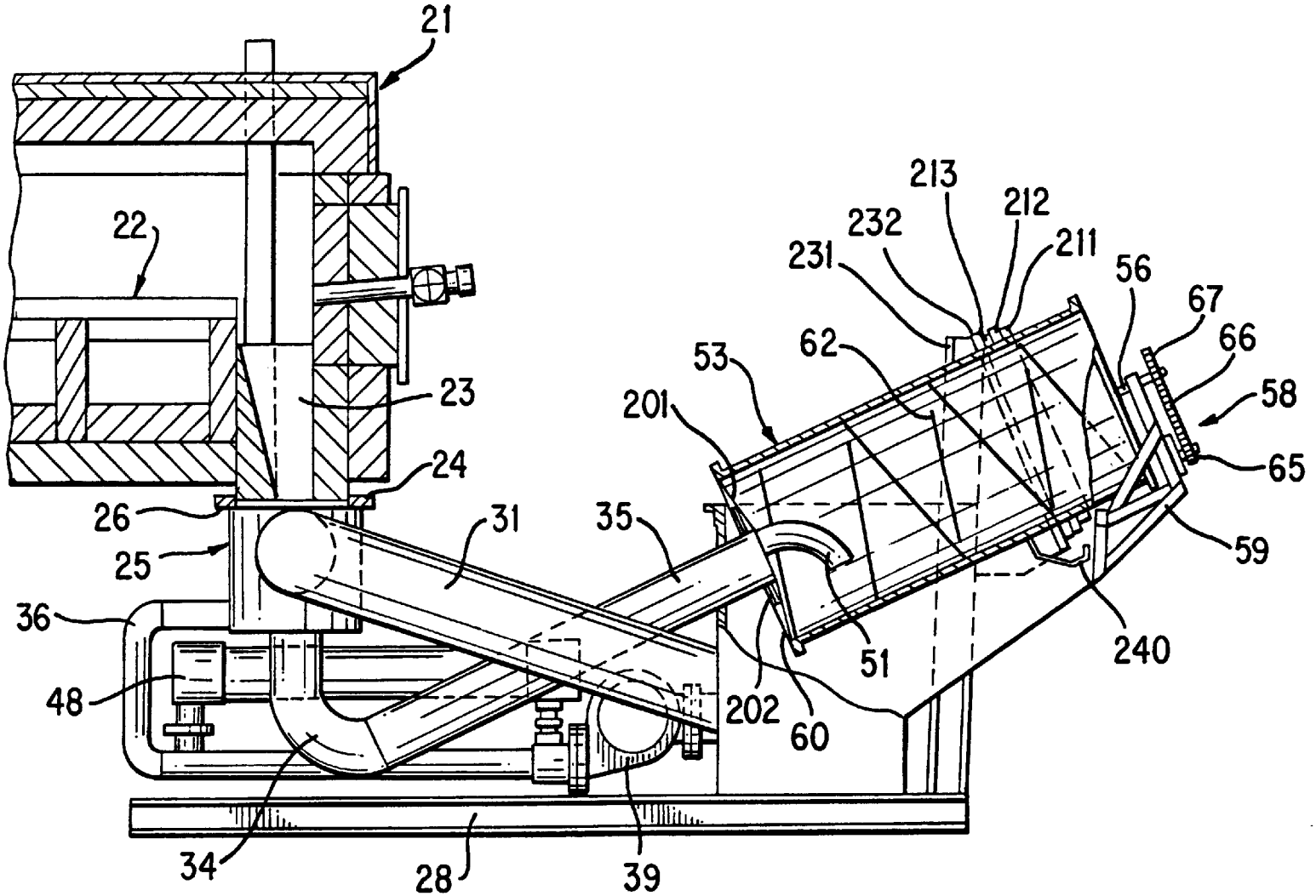
FIG. 2 is a side elevational view in accordance with an embodiment of the invention, partially in section, showing a fragment of a furnace in section, and a portion of the liquid quenching system shown in section which is taken substantially along plane 2—2 of FIG. 1.
Figure 3:
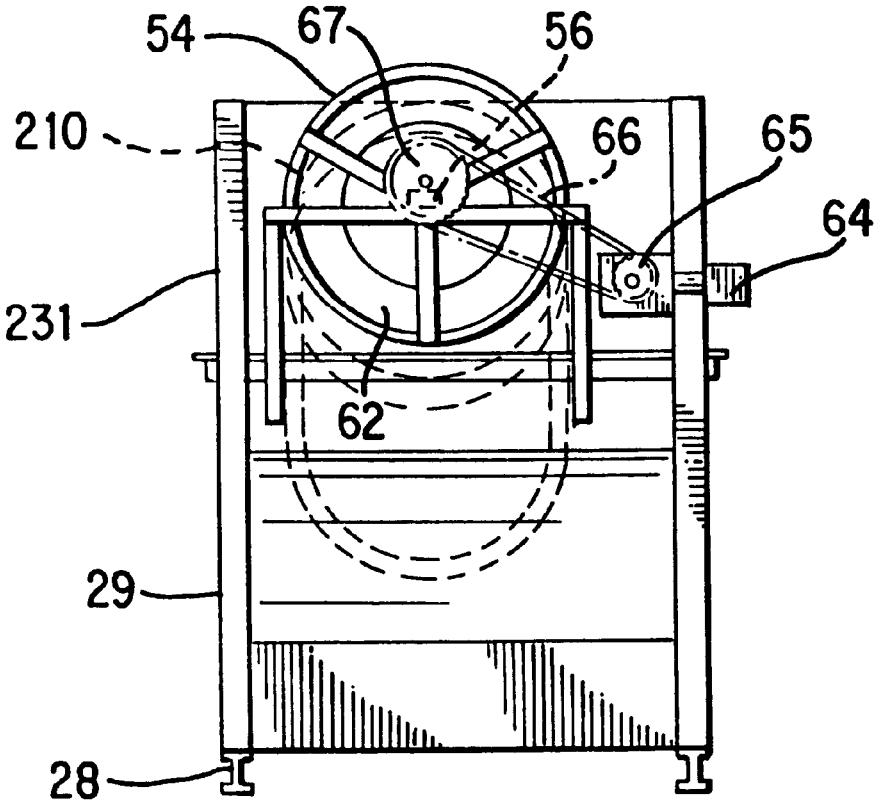
FIG. 3 is an elevational view in accordance with an embodiment of the invention from a reservoir end of the quenching system.

FIG. 1 shows a liquid quenching system generally designated by reference numeral 20. As shown in FIG. 2, the liquid quenching system of the invention is intended to be used with a continuous furnace such as the shuffle hearth furnace 21 which is merely representative of one of several different types of furnaces which may be used with the invention.

The furnace 21 is shown in FIG. 2 to better illustrate the relationship between the quench system and furnace. Any one of a number of different types of furnaces generally used for the processing of small parts such as shuffle hearth furnaces, shaker hearth furnaces, or conveyor belt furnaces would work well with the quench system of the invention. In any of these types of furnaces, the part to be heat treated, generally including small parts such as screws, nuts, washers, bolts or pins which can range in size from a fraction of an ounce to a number of pounds, are moved through the furnace as they are being heated along a hearth similar to that designated by reference numeral 22. When these parts reach an end of the hearth 22, they are automatically discharged by gravity through a discharge channel 23 or similar device. A flange 24 is provided at the bottom of the furnace discharge channel.

A quench connector 25 is secured to the bottom of the furnace immediately below the discharge channel 23. Connection can be accomplished by a nut and bolt assembly connecting the flange 26 on the quench connector to the furnace flange 24. Although not shown in the drawings, asbestos rope or similar material may be placed between the flanges to maintain a gas-tight seal in the event that the heat treating is being done under a controlled atmosphere. As will be more fully explained later in this specification, the quench system of the invention is well suited to maintaining a seal against either loss, or contamination of, the controlled atmosphere during the quenching process.

The entire liquid quench system can be supported on a platform or skid such as that designated by reference numeral 28, making it an integral, self-contained unit which can be easily connected to any existing furnace installation merely by making the above-described attachment of the quench connector 25 to the furnace. It will, of course, be necessary to make suitable power connections as well as to connect various pipe lines for supplying quenchants. However, it is not necessary to excavate any pits for the quench system which, as will be appreciated by those involved in the erection and maintenance of heat treating facilities, can prove an expensive, time-consuming and burdensome task.

Platform 28 supports the reservoir or tank 29 which will contain the greater portion of the quench fluid present in the system at any time. Interconnecting the reservoir 29 and the quench connector 25 is a supply conduit 31 which angles upwardly from the tank 29 to the quench connector 25. The conduit 31 is used to maintain a quenchant level in the quench chute somewhat below the top of the connector 25 and works under the principle that under normal pressure liquid will seek its own level in any interconnected columns.

Figure 6:
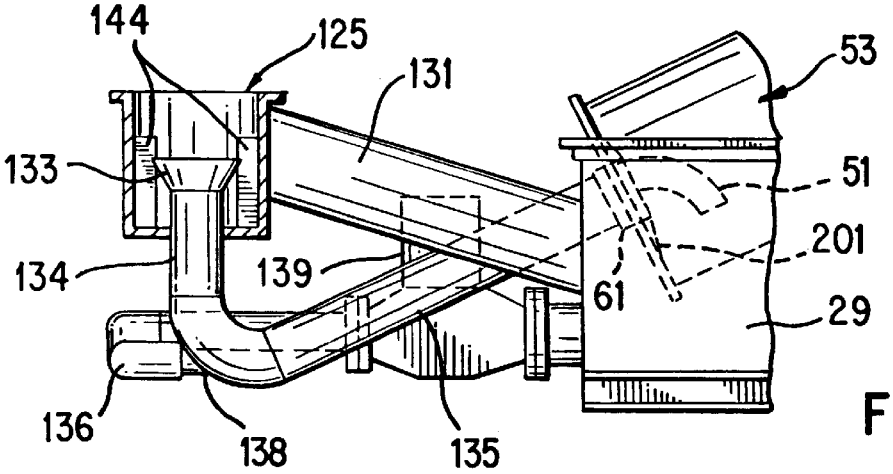
FIG. 6 is a fragmentary side elevational view in accordance with an embodiment of the invention.

It will be noted from FIGS. 2 and 6 that the conduits 31 and 131 shown respectively therein are both inclined, although not at the same angle. By maintaining the conduit 31 or 131 at an angle of approximately fifteen to twenty degrees the quenchant itself is used to provide an effective seal against the loss or contamination of any controlled atmosphere that may be used in the furnace 21. Although not shown in the drawings, a seal may also be provided in a horizontal conduit by means of a vertical depending wall within the conduit. Such a wall would extend below the normal operating level of the quenchant and form a liquid seal against the passage of any gas through the conduit in the same manner as the angled conduits 31 and 131. The angled supply conduit or a horizontal conduit with a depending vertical wall maintain a liquid seal in the conduit in spite of any changes in the level of the quenchant that might occur during normal operation of the quench system.

Thus, the quench connector 25, by virtue of the communication with the quench tank 29 through conduit 31, contains an initial volume of quenchant into which the parts or heat treated work from the furnace 21 will drop. As the parts drop into the quench chute connector 25, they are directed by means of a funnel or cone-shaped member 33 into the quench chute proper 34. It is desirable to maintain the quenchant level at approximately two inches above the top of the cone 33. If the level is too low, air may be drawn into the quench chute. If the level is too high, there will not be any turbulence on the surface of the quenchant to minimize splashing.

Also connected to the reservoir 29 is a quenchant feed conduit 36. A pump 39 is included in the feed conduit 36 for pumping quenchant from the reservoir to the quench chute. The details of the pump form no part of the instant invention, and any suitable liquid pump such as the centrifugal type pump 39 or a vertical in-line pump 139 in the alternative embodiment may be used. While the capacity of the pump can vary from installation to installation, it has been found that a 400 to 450 gallon per minute pump cooperates well with a 300 pound per hour shuffle hearth furnace.

Figure 4:
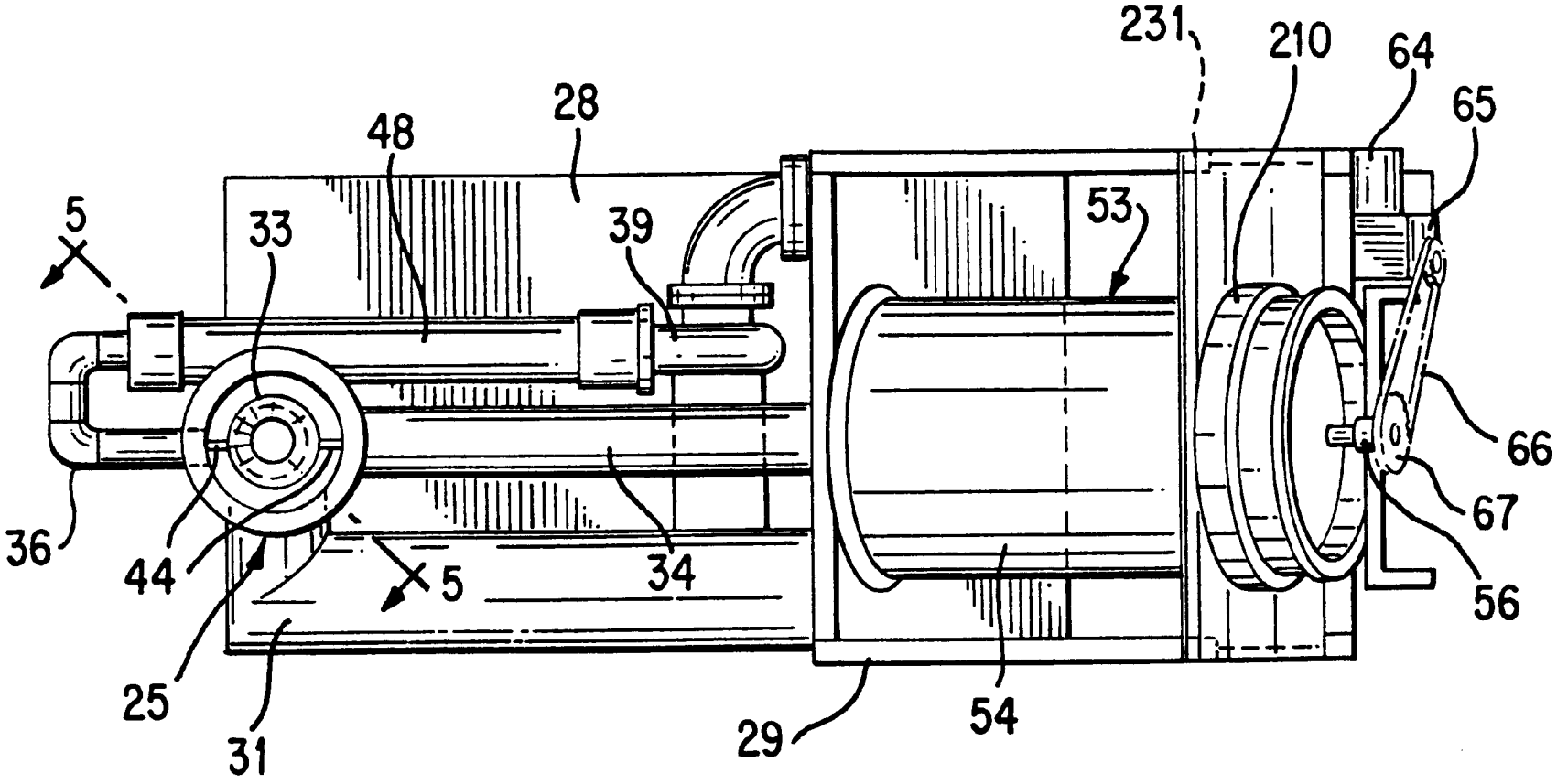
FIG. 4 is a top plan view of the quenching system in accordance with an embodiment of the invention.
Figure 5:
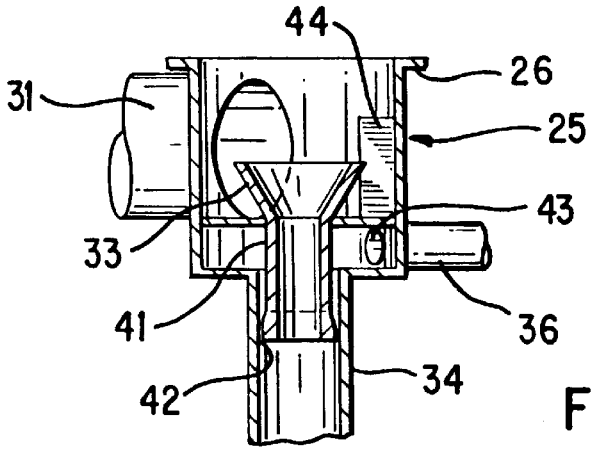
FIG. 5 is an enlarged fragmentary sectional view in accordance with an embodiment of the invention taken substantially along the plane 5—5 of FIG. 4.

The quantity of quenchant pumped through the feed conduit 36 enters the quench connector 25 outside of and below the top of the funnel 33. The funnel 33 is, as best shown in FIGS. 4 and 5, centered within both the quench connector 25 and the quench chute 34. The funnel 33 ends in a straight cylindrical portion 41 extending into the quench chute. Portion 41 is of a smaller diameter and centered within the quench chute 34 thereby forming an annular space. 42. Above the annular space and below the top of the cone 33 is a horizontal wall 43 that prevents the pumped-in quenchant from going up into the furnace. The annular space 42 is of considerably less area than the cross-sectional area of the feed conduit 36, the portion 41 of the funnel or the quench chute 34. As the quenchant is pumped into the quench connector 25 by virtue of the feed conduit 36 and forced through the annular space 42 there is a further increase in the velocity of the added quench fluid. This higher velocity added quenchant carries the heat-treated parts down through the quench chute and up the inclined portion 35 of the quench chute. The specific pressures and velocities involved, of course, vary from application to application depending upon the size and weight of the work being treated, the viscosity of the quenchant, the size of the conduits and quench chute, and of course the distance and more particularly the height through which the work must be conveyed in the inclined portion of the quench chute. Particularly recognizing the variations which can occur taking into account all of the above-mentioned parameters, no specific determination has been made of the maximum angle of incline for the portion 35 of the chute. However, it has been found that the system functions very well when the upwardly-inclined portion 35 is at an angle of approximately 25 degrees to the horizontal.

Baffle members such as vertical baffles 44 are positioned inside the quench connector above the horizontal wall 43 to minimize swirl and eliminate traces of whirlpools that might result from aspiration of the quenchant and work through the funnel 33 by the added quenchant pumped through the annular space 42.

A bypass type heat exchanger such as that designated by the reference numeral 48 can be used in parallel with the feed conduit 36. The heat exchanger 48 can be of any suitable design, the details of which form no part of the invention. While not shown in the drawings, suitable valve means can be included to permit control of the amount of quenchant bypassed through the heat exchanger.

The outlet end of the quench chute 34 extends into the tank 29. In the embodiment shown in the drawings the quench chute passes through the wall of the reservoir although it of course could merely be extended over the top of the reservoir. However, in order to maintain as compact a system as possible and not require the quench conveying system to carry the heat treated parts over any greater height than is necessary, it is preferred to have the inclined portion of the quench chute 35 go through the wall of the reservoir 29 as best shown in FIGS. 2 and 6.

At the discharge end of the quench chute there is provided a deflector member 51. The deflector member 51 is configured to deflect the combination of the quenchant and parts emerging from the chute downwardly while reducing the transverse component of their velocity. In order to permit all the quenchant to return to the quench reservoir (or at least a very high percentage of the liquid to return because there is always an amount of quenchant that adheres to the work and is dragged out with the "dry" work) there is provided segregating or separating means generally designated by reference numeral 53.

It is desirable to prevent splashing of the quenchant and to reduce the noise of the parts banging against the deflector 51. Accordingly, the combination of the quenchant and parts is discharged from the quench chute at a position under the normal level of the quenchant in the quench reservoir. However, a more important aspect of discharging the quench chute effluent below the level of the quenchant is that it prevents aeration of the quenchant, particularly when oil is utilized as the quenchant. Aeration is known to be deleterious to the quality of the quench. While the work could of course be discharged into an apertured container or a screen disposed within the tank 29 to collect the parts for eventual retrieval from the tank by a separate operation, such an arrangement would not be in keeping with a continuous automatic operation such as is envisioned by the use of a shuffle hearth, shaker hearth or a conveyor belt type furnace. Similarly, while a mesh conveyor belt or apertured skip bucket type arrangement could be used, such arrangements would merely result in a partial solution to the types of mechanical handling problems which were experienced with the prior art pit type quench systems in that parts would still be lost into the quench reservoir and parts could jam or otherwise require repair of the conveyor system.

The segregating means 53 of the invention comprises a substantially closed structure formed of foraminous material which prevents the loss of any parts and permits the through-flow of the quenchant which is at least partly within the quench tank. The segregated means 53 is supported for rotation at an angle to the horizontal. A drum 54 for receiving the deflected parts and quenchant is mounted for rotation about the inclined portion 35 of the quench chute and supported for rotation by bearing 210. A shaft 56 located at the discharge end is supported for rotation on the reservoir. The receiving end of the drum is in the tank 29 below the level of the quenchant and lower than the discharge end of the drum which extends slightly beyond the reservoir. It is convenient to support the shaft 56 along with the various drive components generally designated by reference numeral 58 on a shelf 59 mounted on the quench tank 29.

Figure 8:
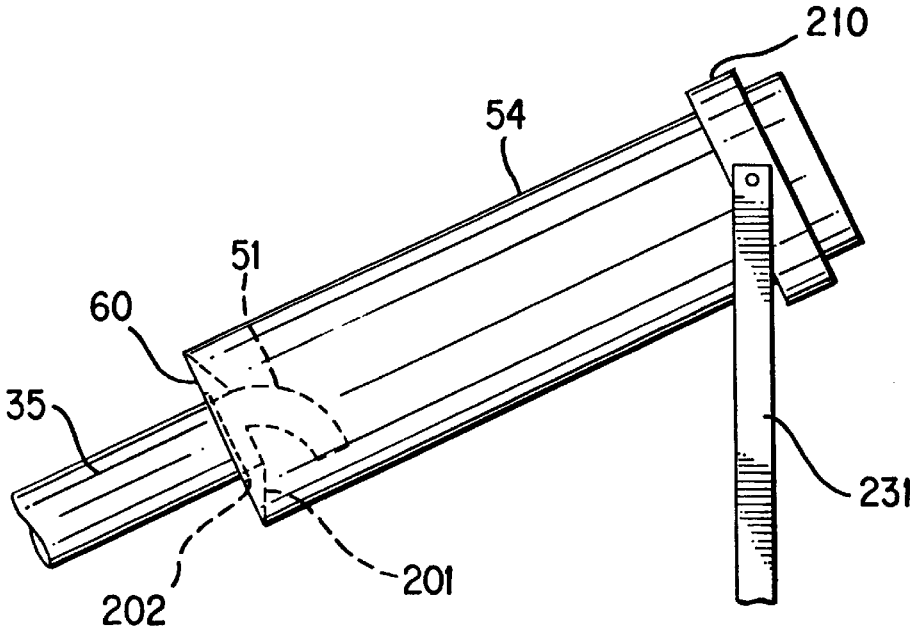
FIG. 8 is a side elevational view of a rotary quenching drum, bearing and quench chute in accordance with an embodiment of the invention.
Figure 11:
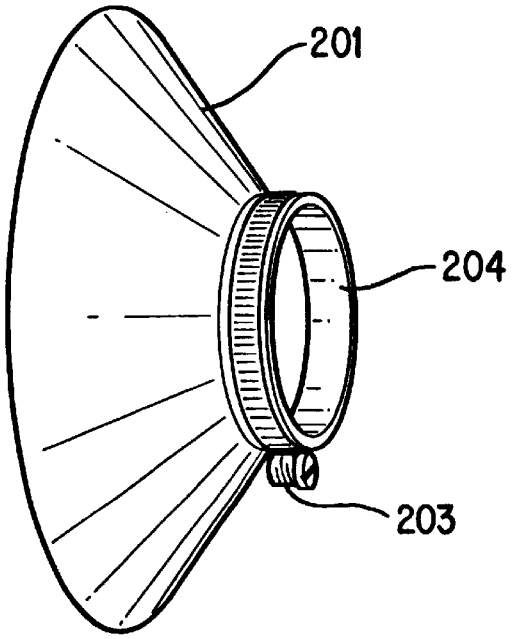
FIG. 11 is a perspective view of a protection member in accordance with an embodiment of the invention.

The lower end of the drum 54 has an end wall member 60 with a central aperture around which is formed a seal 202, as shown in FIG. 8, that functions as a bearing surface for the rotation of the drum 54 about the inclined portion 35 of the quench chute. When mounted on the quench chute, the lower or receiving end wall 60 of the drum is closed, thereby preventing any parts from dropping into the reservoir 29. Additionally, a protection member 201, for example a conical flange, can be attached to an end portion of the inclined portion of the quench chute 35 to ensure that no parts will come into contact with seal 202. The protection member 201 prevents parts from contacting the seal and causing damage and thereby also prevents parts from making their way through the seal and dropping into the reservoir 29. The protection member can be attached to the quench chute 35 by any known attachment means, including set screws, ring collars, and press fitting. As shown in FIG. 11, the preferred configuration for the protection member 201 is the shape of a cone extending from the quench chute 35 and expanding to either contact or nearly contact the end wall member 60 of the drum 54.

Contained within the drum 54 is an auger flight 62 which acts as a screw conveyor for the quenched pieces. The auger flight 62 transfers parts out of the quench tank and deposits them into a suitable receptacle adjacent to the quench system. Alternatively, the parts could be discharged from the segregating means 53 into another continuous conveying means to transport the complete heat treated and quenched parts to another location for further processing, storage or shipment. A portion of the auger flight 62 has been omitted from FIG. 2 to better show the deflector 51. The inclined auger flight reduces dragout of the quenchant in that the parts are in effect "tumble dried" as they are moved up the rotating drum 54.

Under certain conditions it is possible that parts may be conveyed through the quench chute at a rate that is too fast to allow completion of the quench. Usually, the initial contact between the parts and the quench will have been sufficient to completely expose all of the surface area of the parts as they are conveyed and agitated through the chute to thoroughly and effectively quench the surface. However, for some of the larger parts, further time within the quenchant may be required. Hence, in the invention, as the parts emerge from the outlet end of the quench chute 34 they are maintained in the quenchant contained in the lower, submerged receiving end of the drum 54. Therefore, the parts are subjected to an additional quench period before they are transferred out by means of the auger flight 62 mounted in the rotating drum 54.

The inclined, rotating, foraminous, circumferential wall of the separating means 53 also acts as a filter to remove any scale from the quenchant that may fall off the parts as they are passing through the quench chute.

The drive mechanism for the drum 54 may comprise any suitable power source and transmission. For example, as shown in FIGS. 1 through 4 the drive mechanism 58 comprises a motor 64 having a sprocket 65 which, through the chain 66, drives the gear 67 keyed to the axle 56.

Figure 7:
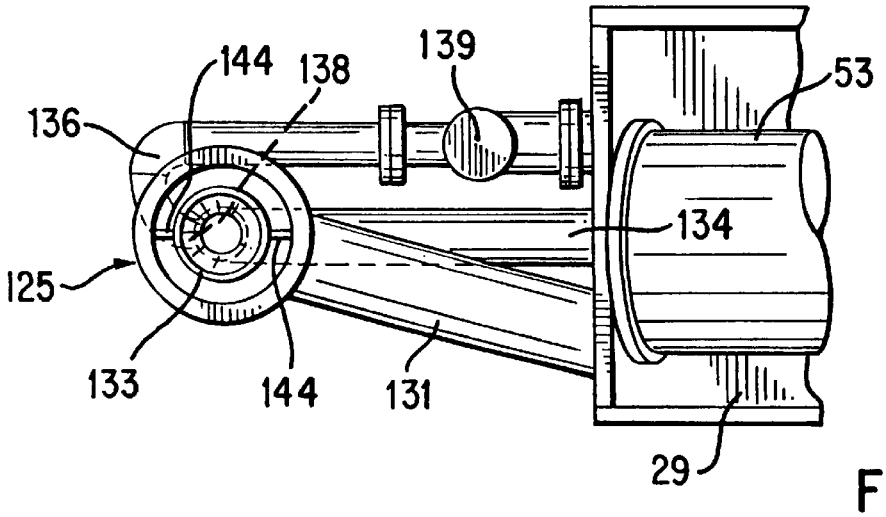
FIG. 7 is a fragmentary top plan view in accordance with an embodiment of the invention.

An alternative embodiment shown in FIGS. 6 and 7 differs from the embodiment previously discussed primarily in the manner in which the added quenchant is pumped into the quench circuit. There are of course some other minor differences such as the previously-mentioned difference in the angle of the supply conduit that is designated as 131 in the alternative embodiment and the different type of pump which is designated as 139 in the alternative embodiment. In the alternative embodiment, rather than being connected to the quench connector 125, the feed conduit 136 is connected directly to the quench chute 134 at 138, approximately where the chute changes direction from a downward, substantially vertical chute to the upwardly-inclined horizontal portion 135. A flared portion of the inlet end of the quench chute itself forms the funnel 133. Baffle members 144 are provided in the quench connector 125 to minimize any swirls or whirlpools. The feed conduit 136 at the point of connection 138 is substantially horizontal and, hence, the higher velocity quenchant is introduced into the quench chute 134 horizontally. This horizontally injected, higher velocity quenchant picks up the parts after they have dropped by gravity through the vertical portion and conveys them upwardly and out of the inclined portion 135. The combined quenchant and work emerging from the inclined portion of the quench chute strikes a deflector 51, similar to that described in the embodiment shown in FIG. 2, and then drops into segregating means 53 as discussed above.

FIG. 8 is a side view of the rotary quenching drum 54, bearing 210 and inclined portion of the transfer chute 35. The rotary quenching drum 54 rotates with respect to the transfer chute 35 about a rotatable joint 202. Protection member 201 is located within the rotary quenching drum 54 as shown in FIG. 8 and protects the rotatable joint 202 from contact with metal parts being conveyed through the system. The protection member 201 can be formed as a conical flange that extends from the end of the inclined portion of the transfer chute 35 to either contact or almost contact the end wall member 60 of the rotary quenching drum. Accordingly, work parts are preventedfrom contacting the rotatable joint 202.

A bearing 210 can be located on the outside of the rotary quenching drum 54 and adjacent to the rotary quenching drum's output end. The bearing 210 is designed to be connected to a bearing shaft 231 to provide cantilevered support to the rotary quenching drum 54. Because the majority of the rotary quenching drum's weight is supported by bearing 210 and bearing shaft 231, it is not necessary for the rotatable joint 202 to provide a great deal of support to the rotary quenching drum 54. Accordingly, deterioration of the rotatable joint 202 is effectively prevented and the elimination of the need for a heavy bearing, or any bearing at all, at the rotatable joint 202 is accomplished.

Figure 9A:
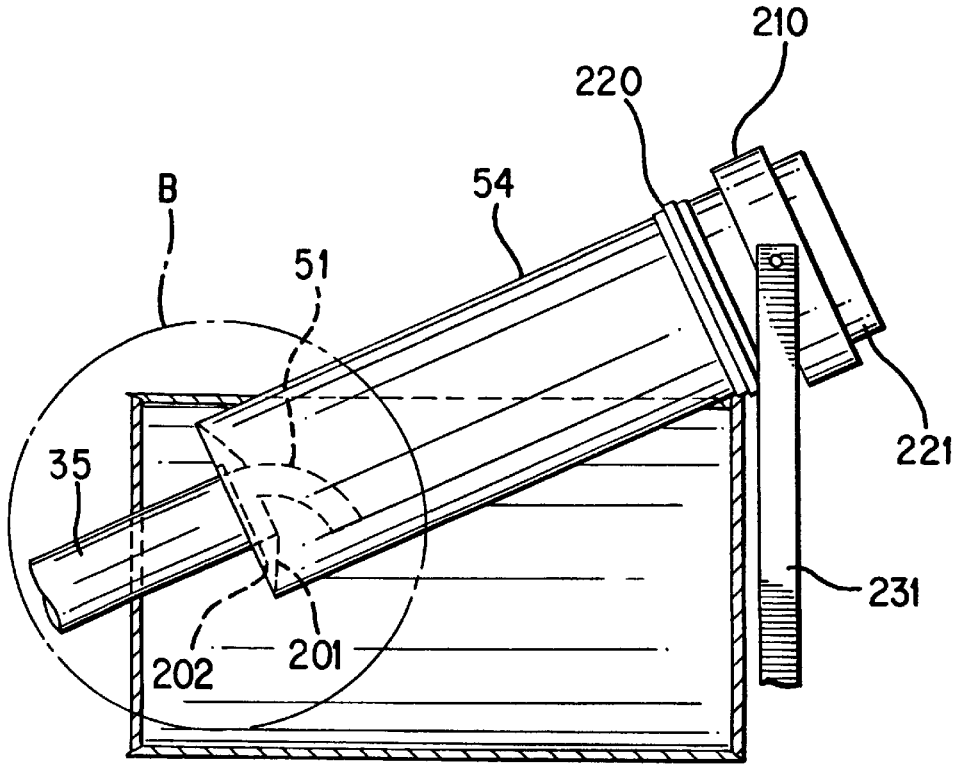
FIG. 9A is a side elevational view of the rotary quenching drum, bearing and quench chute and cross-sectional side view of the quench tank in accordance with an embodiment of the invention.

FIG. 9A is a side view of the rotary quenching drum 54, bearing 210 and inclined portion of the transfer chute 35 in accordance with another embodiment of the invention. This embodiment includes a rotary quenching drum tubular extension 221 that can be retrofitted onto existing rotary quenching drums 54 by a flange joint 220. The rotary quenching drum tubular extension 221 provides the connective means for connecting the bearing 210 to the rotary quenching drum 54. Once an existing rotary quenching drum 54 is modified to include the rotary quenching drum tubular extension 221, bearing 210 and bearing shaft 231, the original bearing structure that provided rotatable support between the inclined portion of the transfer chute 35 and rotary quenching drum 54 can be entirely removed or replaced with another structure that would comprise the rotatable joint 202. A protection member 201 can then be installed to protect the rotatable joint 202 from contacting the work parts.

Figure 9B:
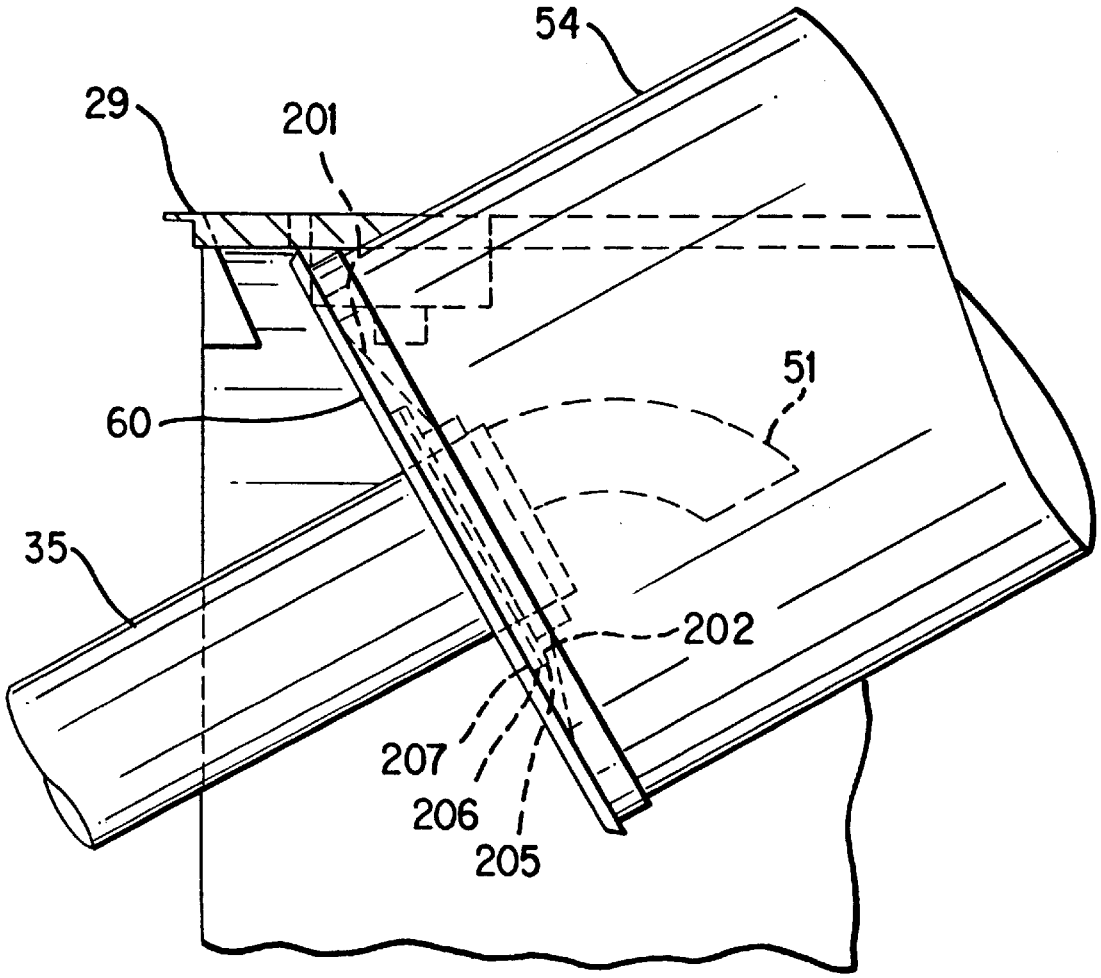
FIG. 9B is an enlarged elevational view of a portion marked B in FIG. 9A.

FIG. 9B is a zoomed view of the area in FIG. 9A marked B. The protection member 201 is connected to an end of the inclined portion of the transfer chute 35 located inside the rotary quenching drum 54. The rotatable joint 202 as shown in FIG. 9B comprises a transfer chute connection portion 205 that connects the rotary quenching drum 54 to the rotatable joint 202, a transfer chute ring bearing 206, and a rotary quenching drum connection portion 207 that connects the rotatable joint 202 to the rotary quenching drum 54. However, other structures could conceivably comprise the rotatable joint 202, such as a simple annular friction bearing made of plastics, metals, ceramics or the like. The simple annular friction bearing can include a lubricant to facilitate rotation of the rotary quenching drum 54 relative to the quench chute 35.

In addition, the rotatable joint 202 can conceivably include no bearing structure at all and comprise the open juncture between the rotary quenching drum 54 and the inclined portion of the quench chute 35. Because the rotary quenching drum 54 is located in the quench tank 29, any quenchant that passes through the rotatable joint 202 will be retained in the quench tank 29.

Figure 10:
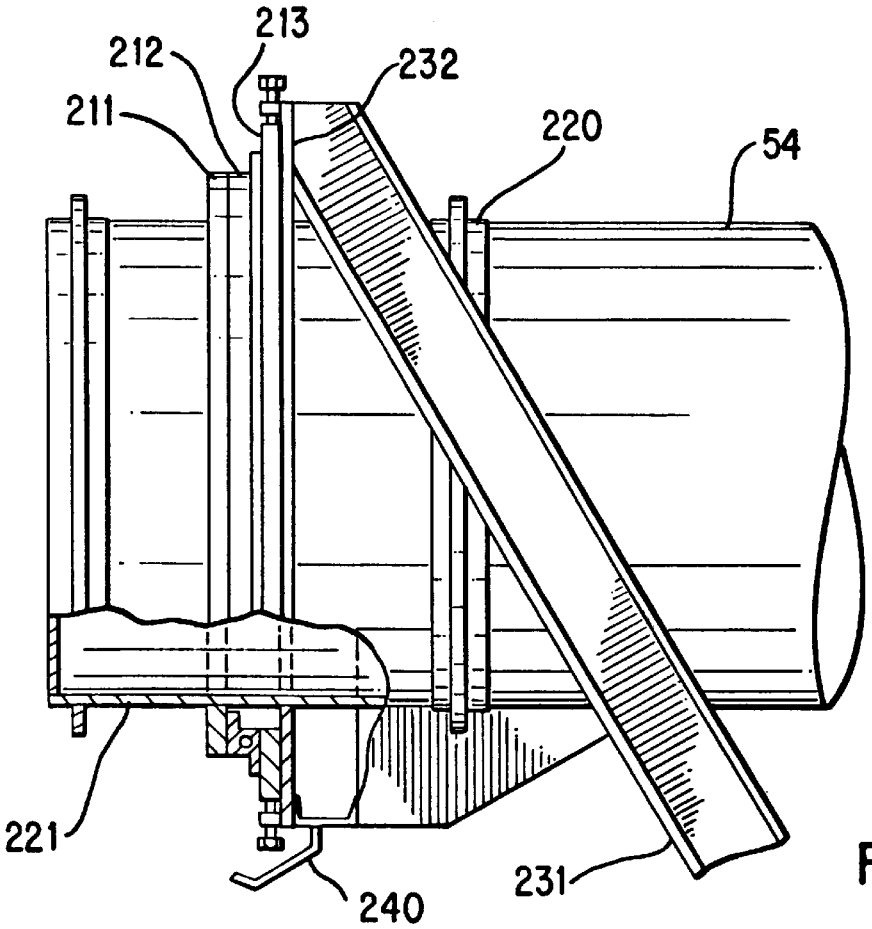
FIG. 10 is a side elevational view of the rotary quenching drum and bearing in accordance with an embodiment of the invention.

FIG. 10 is a side view of the rotary quenching drum 54 in accordance with another embodiment of the invention. A ring bearing 212 is connected to the rotary quenching drum tubular extension 221 by a drum mounting 211. The ring bearing 212 is mounted to the bearing shaft 231 and bearing support plate 232 by a fixed mounting 231. A drip trough 240 is located at the lower side of the drum mounting 211, ring bearing 212 and fixed mounting 213 to catch any excess quenchant that is released at the output end of the rotary quenching drum 54.

FIG. 11 is a perspective view of the protection member in accordance with an embodiment of the invention. The protection member 201 can be shaped in the form of a cone or a lampshade and includes a protection member connector 203 at a smaller diameter end of the structure. As shown in FIG. 11, the protection member connector 203 comprises a ring clamp fitted over a neck 204 of the protection member. The ring clamp connector can be tightened to force the neck 204 to clamp against the outer end of the inclined portion of the transfer chute 35 to attach the protection member 201 to the transfer chute 35. The protection member connector could conceivably comprise other known connectors other than a ring clamp connector, such as set screws provided in the neck 204, a press fit of the neck 204 onto the transfer chute 35, a weld, or any other connection means known in the art. The protection member 201 can be made from any suitable material that can withstand the environment within the rotary quenching drum 54. Some examples of materials that can be chosen for the protection member 201 are heat resistant plastics, metals, kevlar, metal meshes and ceramics.

While specific embodiments of the present invention have been shown and described, it will be apparent to those skilled in the art that various changes and modifications may be made without departing from the invention in its broader aspects, and it is, therefore, contemplated in the appended claims to cover all such changes and modifications as fall within the true spirit and scope of the present invention.

What is claimed is:

1. A quenching apparatus for quenching heated parts, comprising:

a rotary quenching drum having an input end and an output end, the input end including a floor member;

a quench chute connected to the rotary quenching drum for transporting heated parts to the rotary quenching drum;

a rotatable joint inside the rotary quenching drum connecting the quench chute to the rotary quenching drum such that the rotary quenching drum is rotatable relative to the quench chute; and a protection member separate from the quench chute positioned over the rotatable joint to protect the rotatable joint from contact with the heated parts.

2. The quenching apparatus of claim 1, wherein the protection member is shaped as a conical flange having a small diameter end and a large diameter end.

3. The quenching apparatus of claim 2, wherein the large diameter end of the protection member extends from the small diameter end of the protection member and contacts the floor member of the input end of the rotary quenching drum, and further wherein a connection member connects the small diameter end of the protection member to the quench chute.

4. The quenching apparatus of claim 1, further comprising:

cantilever means for supporting the majority of weight of the rotary quenching drum from the output end of the rotary quenching drum such that the rotary quenching drum is rotatable relative to the quench chute.

5. The quenching apparatus of claim 1, further comprising:

a bearing located on the outside of the rotary quenching drum for supporting a majority of the weight of the rotary quenching drum while allowing the rotary quenching drum to rotate relative to the quench chute.

6. The quenching apparatus of claim 5, wherein the bearing is a ring bearing and is located at the output end of the rotary quenching drum.

7. The quenching apparatus of claim 5, further comprising:

a tubular extension attached to the output end of the rotary quenching drum, wherein the bearing is located on the tubular extension.

8. The quenching apparatus of claim 5, further comprising:

a bearing support attached to the bearing for providing support to the bearing.

9. The quenching apparatus of claim 8, wherein the bearing support and bearing are located at the output end of the rotary quenching drum and cooperate to provide a cantilever support to the rotary quenching drum.

10. A quenching apparatus for quenching heated parts, comprising:

a rotary quenching drum having an input end and an output end;

a quench chute for delivering heated parts to the rotary quenching drum;

a rotatable joint inside the rotary quenching drum for rotatably connecting the rotary quenching drum to the quench chute; and a protection means separate from the quench chute positioned over the rotatable joint for protecting the rotatable joint from contact with the heated parts.

11. The quenching apparatus of claim 10, wherein the protection means is a lampshade shaped structure having a small diameter end and a large diameter end.

12. The quenching apparatus of claim 11, further comprising:

a connection member connecting the small diameter end of the protection means to the quench chute; wherein the large diameter end of the protection means extends towards the input end of the rotary quenching drum.

13. The quenching apparatus of claim 10, further comprising:

a bearing located on the outside of the rotary quenching drum for supporting a majority of weight of the rotary quenching drum while allowing the rotary quenching drum to rotate with respect to the quench chute.

14. A quenching apparatus for quenching heated parts, comprising:

a rotary quenching drum having an input end and an output end;

a quench chute for transporting the heated parts to the rotary quenching drum;

a rotatable joint inside the rotary quenching drum connecting the quench chute to the input end of the rotary quenching drum such that the rotary quenching drum is rotatable relative to the quench chute; and bearing means located at the output end of the rotary quenching drum for supporting a majority of weight of the rotary quenching drum.

15. The quenching apparatus of claim 14, wherein the bearing means comprises a ring bearing located on the outside of the rotary quenching drum and attached to a bearing support.

16. The quenching apparatus of claim 14, wherein the bearing means provides a cantilever support for the rotary quenching drum.

17. The quenching apparatus of claim 14, further comprising:

a protection member positioned over the rotatable joint to protect the joint from contact with the heated parts.

18. The quenching apparatus of claim 17, wherein the protection member is shaped as a conical flange.

19. The quenching apparatus of claim 14, further comprising:

protection means positioned over the rotatable joint for protecting the joint from contact with the heated parts.

20. A method for quenching heated parts using a quenching apparatus that includes a rotary quenching drum having an inlet end and an outlet end and a rotatable joint inside the rotary quenching drum connected to a quench chute, the method comprising:

drawing heated parts from a furnace to the rotary quenching drum using a quenchant fluid to provide the motive force;

providing the rotary quenching drum with a protection member separate from the quench chute at the rotatable joint to protect the rotatable joint from contact with the heated parts; and removing the heated parts from the quenchant fluid and from an outlet end of the rotary quenching drum.

21. The method for quenching heated parts of claim 20, further comprising:

supporting a majority of weight of the rotary quenching drum with a bearing and bearing support placed at the outlet end of the rotary quenching drum.

22. The method for quenching heated parts of claim 21, wherein the bearing is located on the outside of the rotary quenching drum.

23. The method for quenching heated parts of claim 20, further comprising:

retrofitting the rotary quenching drum with a tubular extension; and supporting a majority of weight of the rotary quenching drum with a bearing located on the tubular extension, the bearing being supported by a bearing support.

* * * * *